United States Patent [19]

Dugan

[11] 4,347,028

[45] Aug. 31, 1982

[54] PIPE HANDLING APPARATUS

[75] Inventor: Charles D. Dugan, Odessa, Tex.

[73] Assignee: Automatic Pipe Racker, Inc., Odessa, Tex.

[21] Appl. No.: 76,301

[22] Filed: Sep. 17, 1979

[51] Int. Cl.[3] ..... E21B 19/14

[52] U.S. Cl. ..... 414/22; 414/748

[58] Field of Search ..... 414/22, 23, 745, 24, 414/747, 680, 748, 112, 117, 123, 124; 175/52, 85

[56] References Cited

U.S. PATENT DOCUMENTS

| | | | |
|---|---|---|---|
| Re. 28,071 | 7/1974 | Smart . | |
| 2,656,052 | 10/1953 | Tucker | 414/22 |
| 2,958,430 | 11/1960 | Robishaw | 414/22 |
| 2,999,605 | 9/1961 | DeJarnett | 414/22 |
| 3,053,401 | 9/1962 | Jinkins, Jr. | 414/22 |
| 3,254,776 | 6/1966 | Brown | 414/22 |
| 3,706,347 | 12/1972 | Brown | 414/22 X |
| 3,713,547 | 1/1973 | Beck . | |
| 3,785,506 | 1/1974 | Crocuer et al. . | |
| 3,792,783 | 2/1974 | Brown | 414/22 |
| 3,810,553 | 5/1974 | Crocuer et al. | 414/22 |
| 3,825,129 | 7/1974 | Beck . | |
| 4,235,566 | 11/1980 | Beeman et al. | 414/22 |

*Primary Examiner*—Leslie J. Paperner
*Attorney, Agent, or Firm*—Fleit & Jacobson

[57] ABSTRACT

Pipe handling apparatus for picking up and laying down tubular goods used in land and offshore drilling operations. The apparatus includes a longitudinally extending main support frame; a longitudinally extending movable member including a trough for receiving and retaining therein tubular goods and having an end portion pivotally connected to the support frame; a lift mechanism for moving the movable member between a lowered, substantially horizontal, first position and an elevated, second position. The base member has a portion thereof defining a horizontal support surface extending parallel to and spaced from one or both sides of the movable member when the latter is in the first position; stack mechanism is provided for transferring tubular goods to and from the movable member when the movable member is in the first position. A dump mechanism is operatively associated with the movable member for transferring tubular goods from the movable member to the stack mechanism. A buggy or pusher is positioned in the trough to move tubular goods longitudinally along the trough. The invention also provides a brake for controlling movement of tubular goods from a derrick or other elevated surface to the movable member.

12 Claims, 12 Drawing Figures

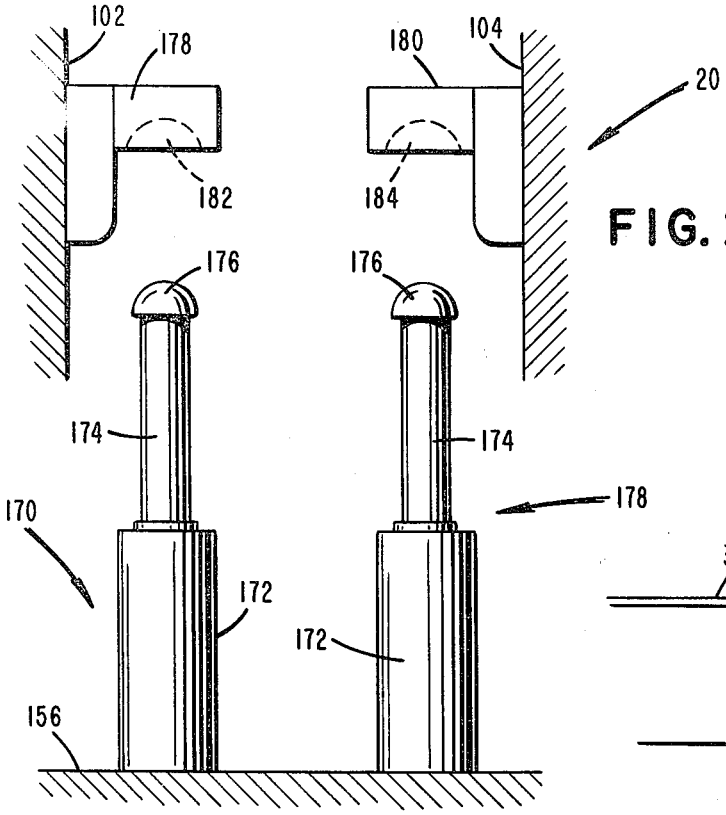
FIG. 10
FIG. 11
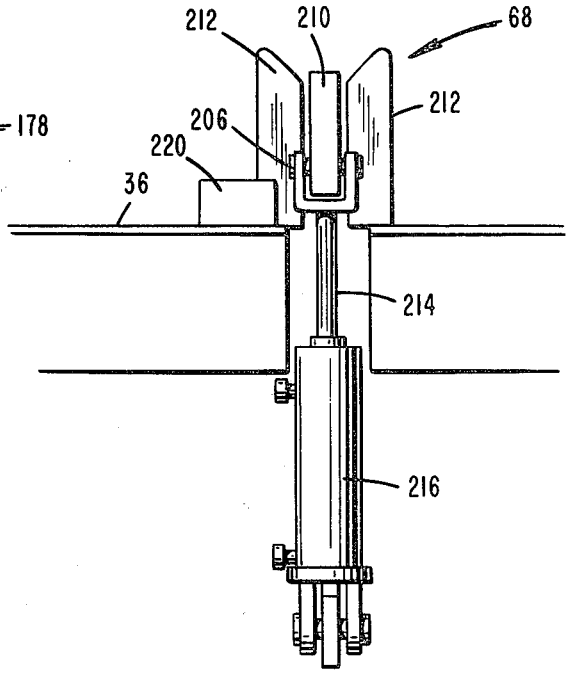
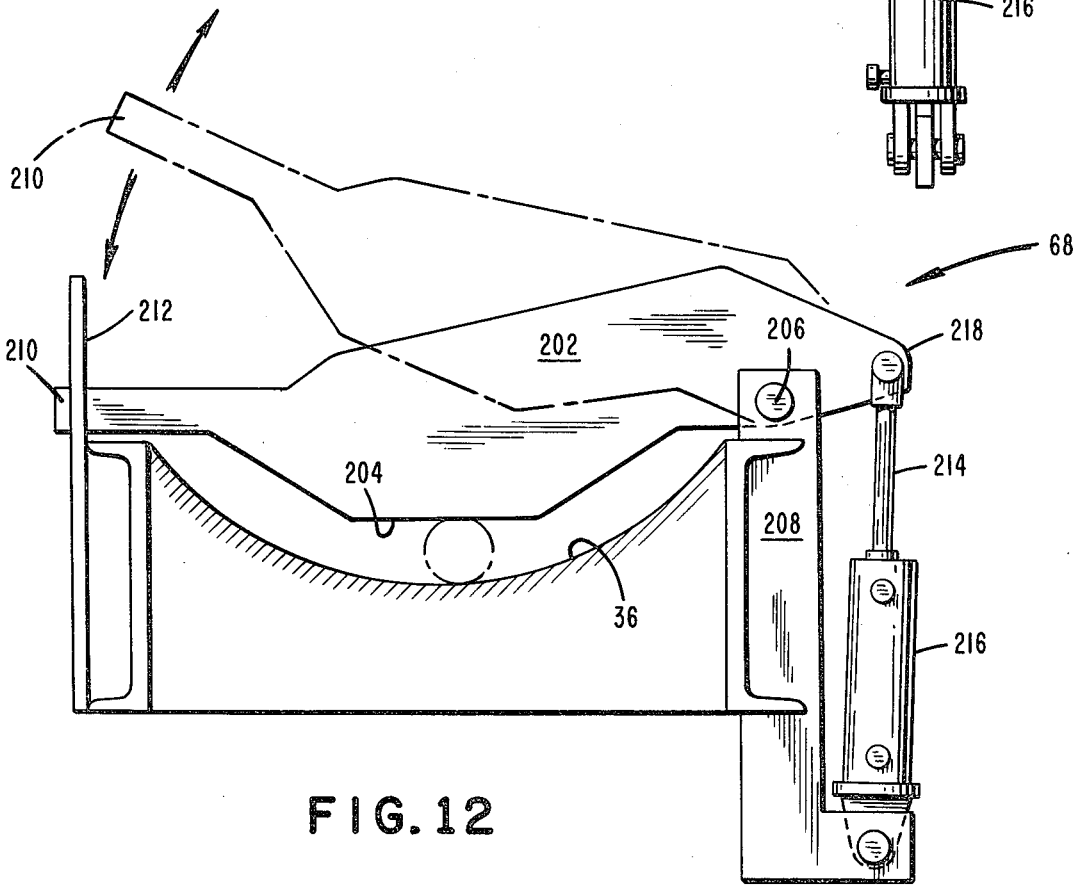
FIG. 12

PIPE HANDLING APPARATUS

BACKGROUND OF THE INVENTION

The present invention relates to pipe or tubular good handling apparatus. More particular, the invention relates to an apparatus for picking up tubular goods and transferring the picked up goods to the floor of a derrick, and for receiving tubular goods from the derrick and stacking or laying down the received goods.

Numerous different types of apparatus are previously known for picking up and laying down tubular goods involved in a drilling operation. Examples of such goods include drill tubing, casing, drill collars and drill pipe. For the purposes of convenience, such tubular goods will hereinafter be referred to as "pipe". It will be appreciated, however, that the present invention can be used to move any type of equipment used with a drilling operation.

Previously known drill pipe handling apparatus are described in U.S. Pat. No. 3,785,506, entitled "Drill Pipe Handling Apparatus" and U.S. Pat. No. 3,810,553, entitled "Pipe Handling Device". Both of these patents describe track-type machines for picking up and laying down pipe. The machines include a lifting device for lifting pipe from a rack and depositing the lifted pipe in an elevated trough. A pair of dollies are positioned in the trough for receiving a pipe deposited in the trough and for transferring the received pipe, through an inclined chute, to the floor of a derrick. The trough used with the devices is rotatable about a horizontal axis to transfer pipe received from the derrick, through the inclined chute, to a device for lowering the pipe onto a pipe rack. A brake is mounted on the inclined chute to control the rate of descent of pipe through the inclined chute during a pipe lay down operation.

Several problems have been encountered with pick up and lay down devices of the type described in the aforementioned patents. For instance, the devices are usually positioned on a cat walk of a derrick and greatly interfere with personnel access to the derrick. Also, assembly and disassembly operations are required when the apparatus is shifted from laying down pipe to picking up and vice versa. For instance, the brake on the inclined chute interferes with feeding of pipe through the chute during a picking up operation. Thus, the brake must be removed. Also, the lifting devices must be removed before the lowering devices can be used.

Other types of pipe handling apparatus are described in U.S. Pat. No. 3,713,547, entitled "Endless Cable Way for Transporting Pipe"; U.S. Pat. No. 3,825,129, entitled "Pipe Handling Apparatus"; and U.S. Pat. No. Re. 28,071, entitled "Portable Type Handling Apparatus". These patents describe wire line machines for picking up and laying down pipe. The machines use a system of cables and pulleys to raise and lower pipe sections.

SUMMARY OF THE INVENTION

The present invention relates to new and improved pipe handling apparatus for picking up pipe, that is, moving pipe from a pipe rack positioned below a derrick floor to the derrick floor. The apparatus is also useful to lay down pipe, that is, transfer pipe from an elevated derrick floor to a pipe rack positioned below the derrick floor.

The invention also provides an apparatus useful with an off-shore well drilling platform for the picking up and laying down of pipe. With such use, it will be appreciated that the pipe rack or other suitable pipe supply storage device is located on the floor of the drilling platform and the floor of the derrick might or might not be positioned above the drilling platform floor.

Considering the present invention in more detail, it provides a main trough that is movable by one or more lift cylinders between a horizontal position and an elevated, inclined position. In the inclined position, the trough has an upper end that contacts or terminates closely spaced from a lower end of an inclined chute connected to the floor of a derrick. The upper end of the inclined chute terminates close to the bore hole formed in the derrick floor.

A cat walk is positioned on one or both sides of the main trough, so that the apparatus can be installed as part of the derrick without interfering, to any great extent, with access to the derrick floor. Also when the main trough is in a horizontal position, it can be used as part of the catwalk.

The trough used with the present invention preferably has a through groove formed in its bottom and downwardly converging sides for receiving and supporting a pipe. It will be appreciated that the trough can have any shape that prevents unintended lateral movement of a pipe with respect to the trough. The trough is supported in a frame in such manner that at least a portion, preferably a central portion, of the trough is rotatable about its longitudinal axis to dump pipe received from the derrick.

The present apparatus includes a main support frame; a longitudinally extending main trough having an end portion pivotally connected to an end portion of the support frame, the main frame defining at least one longitudinally-extending horizontal surface adjacent one edge of the main trough; lift means for moving the main trough between a lowered, substantially horizontal, first position and an elevated, inclined second position; stack means positionable on at least one side of the main trough for transferring tubular goods to and from the main trough; dump means operatively associated with the main trough for transferring tubular goods from the main trough to the stack means; and buggy means positioned in said main trough for movement with respect to said main trough, the buggy means being moveable to move tubular goods longitudinally along the main trough.

Preferably, the main trough has a longitudinally-extending support frame and a semi-cylindrical trough supported by the main frame. The trough is formed from a plurality of sections, with at least a central section support for pivotable movement about a longitudinal axis.

Preferably, the lift means comprises main and auxiliary lift means. The main lift means utilizes at least one lifting device having a cylinder pivotally connected to the support frame and a rod pivotally connected to the trough support frame. The rod is preferably connected to a front edge portion of the trough support frame to provide lateral stability when the trough is elevated. The auxiliary lift means utilizes at least one lifting device positioned between the trough support frame and the main support frame to assist initial movement of the trough from the horizontal towards the elevated position.

The stack means preferably comprises a pair of transport devices longitudinally spaced on at least one side of the main trough. Each of the devices has a conveyor section extending generally perpendicular to the longitudinal axis of the trough, with a first end closely spaced from the trough. The other end of the conveyor section is positioned adjacent a bar extending away from the main frame towards a pipe rack. A tooth is carried by and extends away from the conveyor to engage and move a pipe. The height of the devices is adjustable to allow stacking of pipes in multiple tiers.

The dump means preferably comprises means for pivotally rotating the central portion of the trough so that a pipe carried by the trough is dumped from the trough onto the conveying section of the stack means.

The buggy means preferably comprises a pusher positioned in the trough and having a portion extending downwardly through the groove in the trough. The downwardly extending portion is connected to or driven by a continuous cable or chain that extends underneath substantially the entire length of the main trough.

In one embodiment of the present invention, the apparatus is self-contained and utilizes a hydraulic system for driving the different components of the apparatus. The apparatus is connected to and forms part of the derrick or of an off-shore drilling platform supporting the derrick.

The invention also provides a pipe brake that is permanently connectable to the inclined chute feeding pipe to the trough. Preferably, the brake is connected to the aforementioned hydraulic system for movement between a pipe engaging position and a disengaged position.

During a pipe pick up operation, the brake is moved to the disengaged position so that it does not interfere with movement of pipe through the inclined chute to the derrick. During a pipe lay down operation, the brake is moved to the engaged position to control movement of pipe from the derrick through the chute. Since the brake is hydraulically controlled, it can easily be moved between the engaged and disengaged positions.

The invention, and its objects and advantages, will become more apparent in the detailed description of the preferred embodiments hereinafter presented.

BRIEF DESCRIPTION OF THE DRAWINGS

In the detailed description of the preferred embodiments of the invention hereinafter presented, reference is made to the accompanying drawings, in which:

FIG. 10 is a schematic view illustrating the relationship between two components of the apparatus of FIG. 1;

FIG. 11 is a schematic side view of one embodiment of a brake mechanism usable with the apparatus illustrated in FIG. 1; and FIG. 12 is a front view of the brake mechanism illustrated in FIG. 11.

DESCRIPTION OF THE PREFERRED EMBODIMENTS

Because pipe pick up and laydown apparatus are well-known, the present description will be directed in particular to elements forming part of, or cooperating more directly with, the present invention. Elements not specifically shown or described herein are understood to be selectable from those known in the art.

Figure 1:
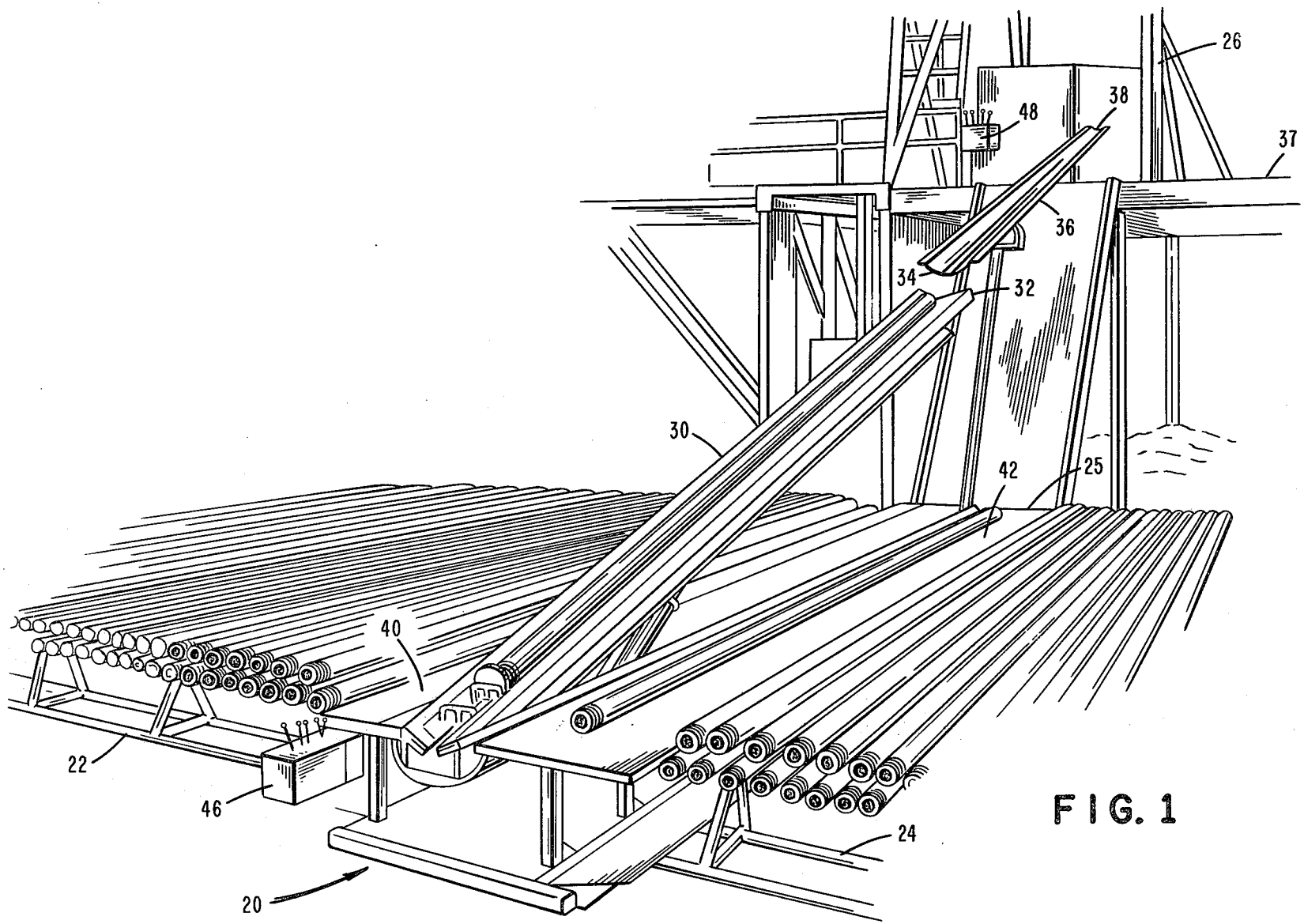
FIG. 1 is a schematic perspective view of one embodiment of an apparatus according to the present invention being used during a pipe lay down operation.

Referring now to the drawings and to FIG. 1 in particular, a pipe handling apparatus, generally designated 20 is illustrated. A first rack 22 for pipe is positioned on the left-hand of the apparatus, and a second rack 24 is positioned on the right-hand of the apparatus. The end 25 of the apparatus is closely spaced from a derrick 26. It will be appreciated that terms such as "left-hand", "right-hand", and "rear" are intended to merely identify structure illustrated in the drawings. They are not intended to limit the description to specific orientation of the components.

While racks are illustrated on both sides of the apparatus, it will be appreciated that racks can be positioned on either or both sides of the apparatus. Also, if desired, the apparatus can be used without racks.

The apparatus 20 has a main chute that is movable between a lowered, substantially horizontal, first position, and a raised inclined position by one or more hydraulic cylinders, or other suitable lifting means to be described in more detail hereinafter. In the raised position, the chute 30 has an upper end 32 contacting or closely spaced from a lower end 34 of an inclined chute 36. Preferably, a tube support surface of the main chute 30 is aligned with a corresponding tube support surface of the inclined chute 36. The chute 36 is releasably or permanently connected to a floor 37 of the derrick 26 in such manner that an upper end 38 of the chute is closely spaced from a bore hole (not shown) in the floor 37.

The apparatus 20 has a left-side portion 40 forming a first catwalk and a right-side 42 forming a second catwalk. The catwalks are positioned on both sides of the main chute 30. It will be appreciated that catwalks can be formed on either or both sides of the chute.

Control means 44, including one or more control stations, such as a station 46 positioned at the front of the apparatus and a station 48 positioned on the derrick floor, are provided for controlling movement of the various mechanisms used with the apparatus.

Figure 2:
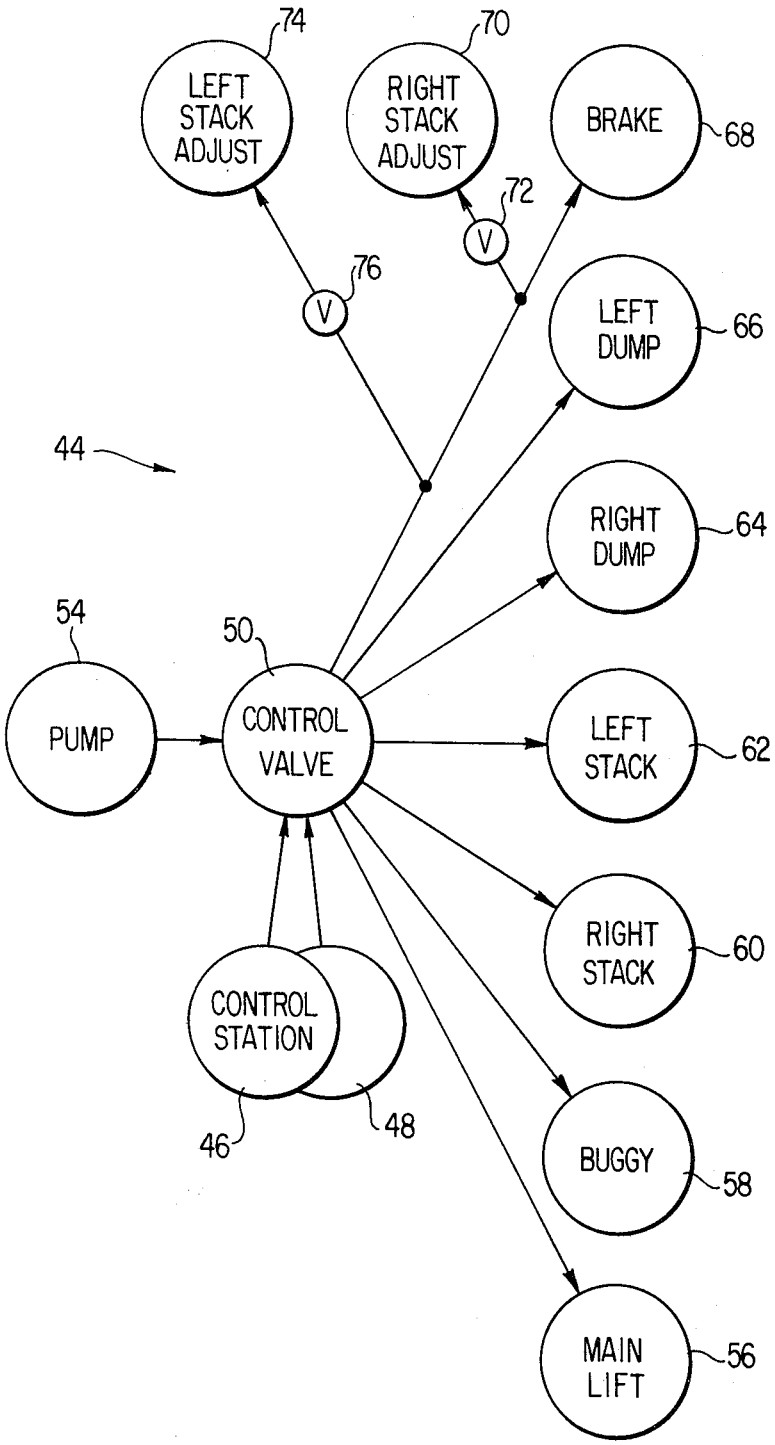
FIG. 2 is a block diagram of a control system used with the apparatus of FIG. 1.

Referring now to FIG. 2, one embodiment of the control means 44 is illustrated. While the described system is a hydraulic system, it will be appreciated that pneumatic and electric systems could also be used. Further, the control operations could be performed manually.

Figure 3:
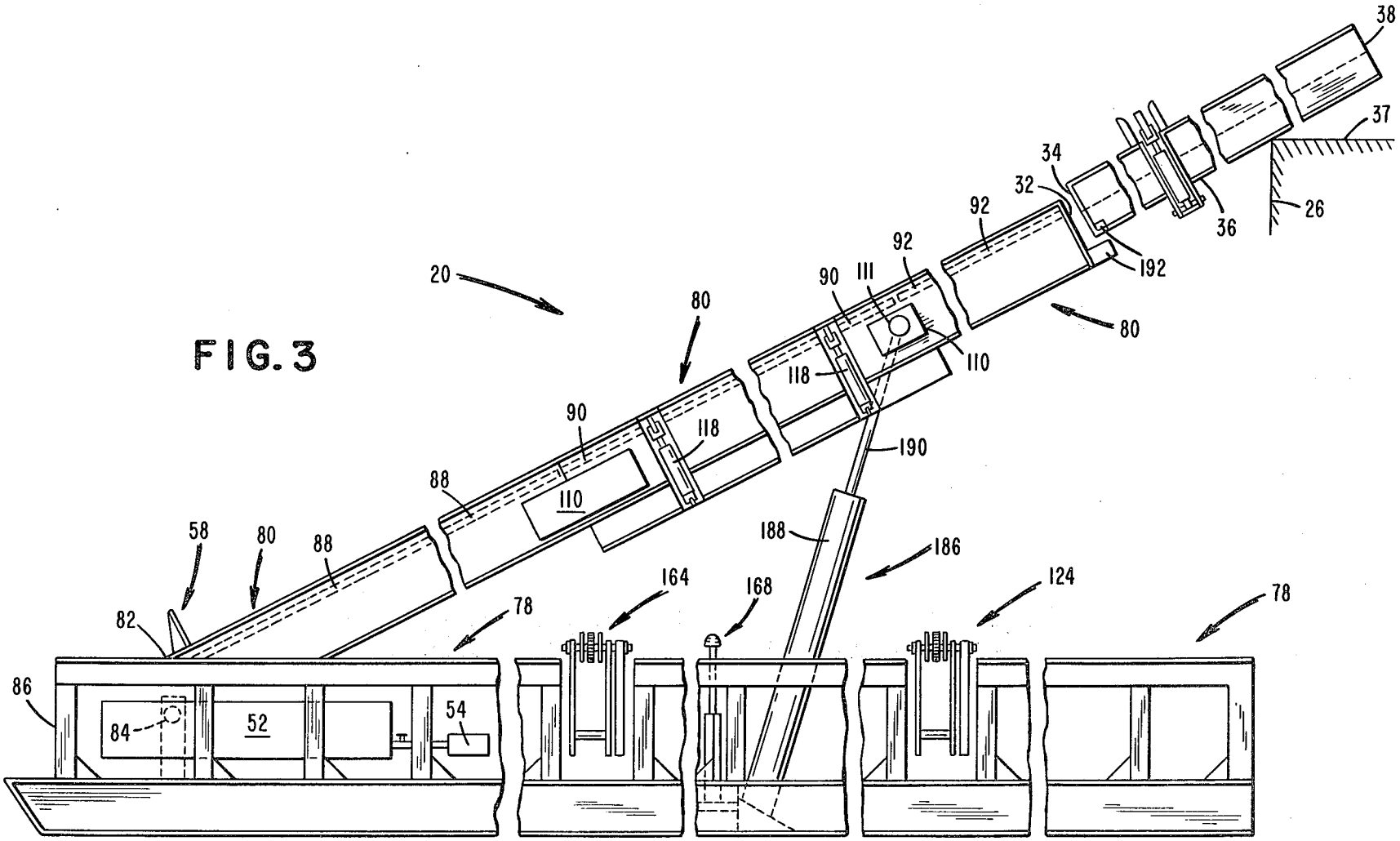
FIG. 3 is a schematic right side view of the apparatus of FIG. 1.

As illustrated in FIG. 2, the control means 44 includes a control valve 50 selectively controlled by the stations 46 and 48. The control valve controls the furnishing of hydraulic fluid from a suitable source that is either part of or separate from the apparatus 20. One suitable source includes a reservoir 52, as illustrated in FIG. 3, that is supplied by a pump 54. For the purposes of convenience, the reservoir has not been illustrated in FIG. 2.

The control valve selectively furnishes hydraulic fluid to mechanisms controlling movement of the following components of the apparatus: main lift 56, a buggy 58, a right stacking mechanism 60, a left stacking mechanism 62, a right dumping mechanism 64, a left dumping mechanism 66, and a brake mechanism 68. A mechanism 70 for controlling the vertical position of the stack mechanism 60 is connected through a valve 72 to the line furnishing hydraulic fluid to brake 68. Similarly, a mechanism 74 for adjusting the vertical height of the left stack mechanism 62 is connected through a valve 76 to the line furnishing hydraulic fluid to the brake 68.

It will be appreciated that many different types of control system can be used with the present invention. For instance, a plurality of pumps can be connected to the control valve, or, alternatively, a separate pump and control valves can be provided for selected ones of the identified components. Also, the furnishing of hydraulic fluid to the different components can be controlled by electrical, mechanical, pneumatical and/or combinations of the preceding control mechanisms.

Referring now to FIG. 3, it can be seen that the apparatus 20 includes a base member or main support frame, generally designated 78, and that the chute 30 comprises a vertically movable member, generally designated 80, having an end portion 82 pivotally connected at 84 to an end portion 86 of base member 78. Preferably, the member 80 is formed of a plurality of interconnected sections, three of which designated 88, 90 and 92, are illustrated.

Figure 4:
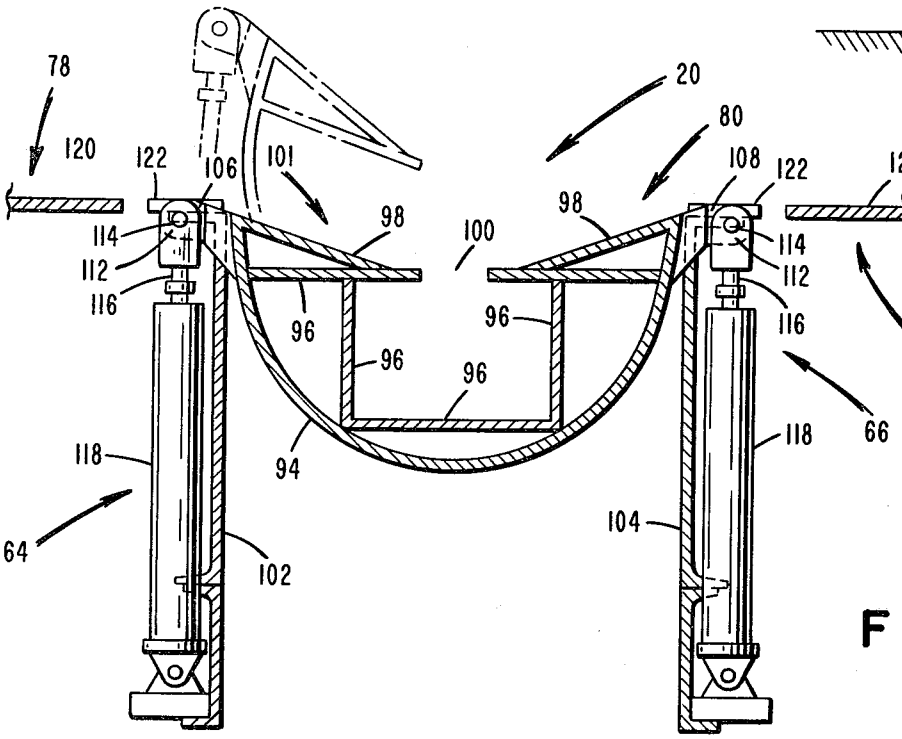
FIG. 4 is a schematic transverse partial cross sectional view of the apparatus of FIG. 1 in a lowered position.

As best illustrated in FIG. 4, the vertically movable member 80 includes a semi-cylindrical shell 94 supporting a plurality of gussets or support members 96 that support plates 98. Upper surfaces of the plates 98 provide means for supporting pipe transported by the apparatus. Two of these plates 96 are horizontally arranged and have distal ends connected to the shell 94 and facing proximal ends spaced from each other to define a gap 100. Thus, the members 96 and 98 combine to define a support trough, generally designated 101.

The movable member 80 also includes a pair of horizontally spaced-apart support members or plates 102 and 104 for supporting the trough 101. Preferably, portions of the trough located in sections 88 and 92 of the member 80 are rigidly connected to plates 102 and 104, while the section 90 is mounted for rotational movement with respect to the plates. For this purpose, portions of upper flanges 106 and 108 of the member 102 and 104, respectively, are cut away to form gaps. Preferably, flange portions of the member 102 and 104 are reinforced by plates 110 in the vicinity of the facing ends of sections 88 and 90 and the facing ends 90 and 92. The plates reinforcing the flanges in the vicinity of ends 90 and 92 also have openings formed therein for receiving a shaft 111 (whose purpose will be subsequently described). The trough 101 has one or more portions 112 projecting into the gaps in the flange portions. These projecting portions have openings formed therein for receiving pins 114 connecting the trough to rods 116 of cylinder 118. As can be seen from FIGS. 3 and 4, a pair of such cylinders 118 is located on each side of the trough 101. It will be appreciated that one pair of the cylinders can be eliminated, if desired to rotate the trough in only one direction. The pairs of cylinders form the right and left dump mechanisms, 64 and 66, respectively, illustrated in FIG. 2.

Referring again to FIG. 4, it can be seen that the cylinders 118 are actuatable to rotate the center section 90 of trough 101 about its longitudinal axis. In this manner, a pipe carried by the trough is dumped from the trough. When dumped, the pipe falls on the upper surface 120 of the base member 78. Sometimes, the pipe falls on the upper flange of the plate, for instance, flange 108 of plate 102. In order to strengthen and prevent damage to the flanges, reinforcing plates 122 are positioned on top of the flanges 106 and 108. These plates, in addition to strengthening these flanges, minimize the gap between base member 78 and trough 101 and insure that the top of the trough is level with the top surface 120 of base member 78. Also, the top surfaces 120 form catwalks or horizontally extending support surfaces on both sides of the trough.

Figure 5:
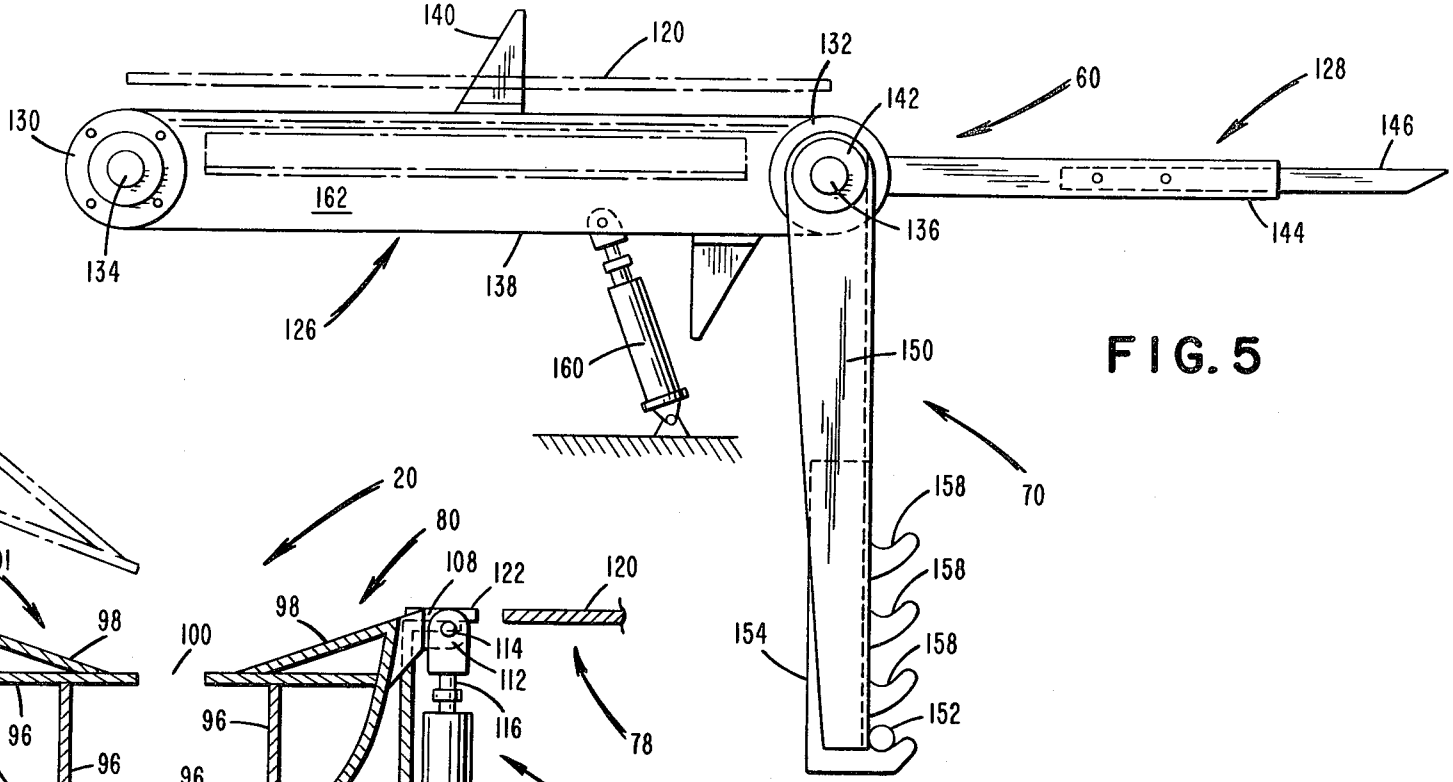
FIG. 5 is a schematic side view of one embodiment of a stacking mechanism usable with the apparatus of FIG. 1.
Figure 6:
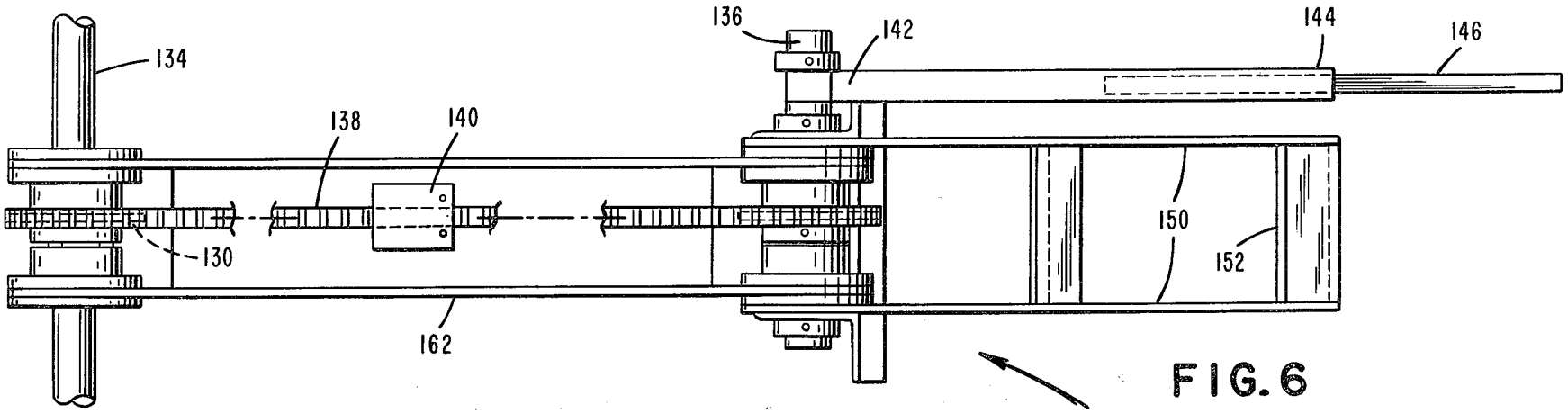
FIG. 6 is a top view of the stacking mechanism of FIG. 5.
Figure 7:
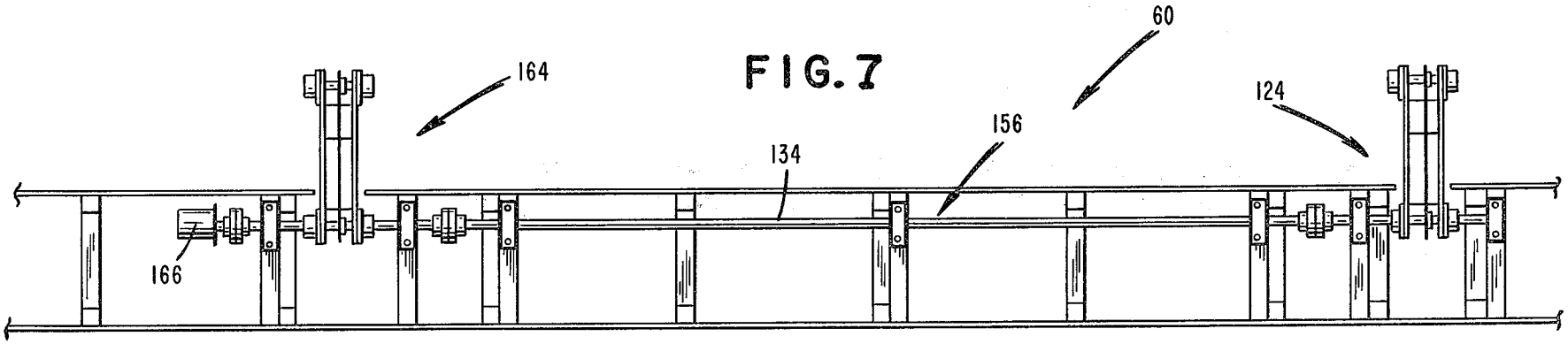
FIG. 7 is a schematic partial side view illustrating a mechanism for controlling movement of the stacking mechanism illustrated in FIG. 5.

Referring now to FIGS. 5, 6, and 7, an embodiment of a stack mechanism, for instance, stack mechanism 60 will be described.

The right stack mechanism 60, includes a first transport mechanism, generally designated 124, having a conveying section, designated 126 and a transfer section, generally designated 128. The conveying section 126 includes spaced-apart sprockets 130 and 132. The sprocket 130 is pivotally driven by a shaft 134, while the sprocket 132 is pivotally supported by a shaft 136. The shaft 136 also supports the transfer section 128. An endless member 126, such as a chain or cable, extends around the sprockets 130 and 132, and is rotatably driven thereby. One or more protruding members or teeth 140 are connected to the endless member 138. Preferably, the sprockets are positioned in such a manner that they are located below the top surface 120 and the teeth 140 project above the surface. Upon rotation of the driven sprocket 130, one of the teeth 140 engages a pipe positioned on the upper surface 120 and transfers the engaged pipe to the transfer section 128. The transfer section has one end 142 mounted for rotation about shaft 136. The other end 144 is adapted to be positioned in such manner that products can be moved by gravity during a pick up operation onto either the conveying section or the catwalk and that products can be moved by gravity from the conveying section or catwalk onto a pipe rack during a lay down operation. When there are several rows of pipes retained on a pipe rack, the end 144 can be positioned on top of the most recently completed stack to facilitate the formation of the next row of the stack. Preferably, end 144 is hollow and receives a telescoping member 146 that can be extended to increase the effective length of the transfer section. Set screws 148, or other suitable means, are provided for locking the end 146 in a desired position.

As illustrated in FIG. 5, the height of the transfer mechanism 124 is vertically adjustable by the right stack adjusting mechanism 70. For this purpose, two support arms 150 are rotatably carried by the shaft 136. Lower portions of the arms 150 are interconnected by a shaft 152.

A support member 154 is rigidly connected to and forms part of the main support frame 78. The support member 154 includes a plurality of spaced-apart support locations 158 for receiving the shaft 152. A lifting device 160, for instance, a piston and cylinder, is positioned between the frame and a member 162 that interconnects the sprockets 130 and 132. The lifting device 160 forms part of the right stack adjusting mechanism 70 of FIG. 2.

Preferably, the vertical position of the sprocket 130 is fixed and only the position of sprocket 132 is vertically adjustable. Sprocket 132 is movable between an elevated position above the level of the catwalks and a lowered position in which all of the transport mechanism 126 is positioned below the surface of the catwalks. In the latter position, the mechanism does not interfere with the movement of goods along the catwalk. Also, since the transport mechanism does not have to be removed from the apparatus, it can be quickly moved into an operating position to assist either pick up or lay down operations.

Referring now to FIG. 7, it should be noted that the right stacking mechanism 60 includes a second transport mechanism 164 that is similar to the first transport mechanism 124. Accordingly, the components of the second mechanism will not be described in detail. It should be further noted that the same shaft 134 rotates or drives the conveying sections of both mechanisms. The shaft 134, in turn, is driven by a mechanism 166 receiving hydraulic fluid through control valve 50.

In order to provide maximum flexibility, it is desirable to position a left or second dump mechanism 66, which is similar to mechanism 64, on the other side of the main frame 78.

The main lift 56 of FIG. 2 will now be described with reference to FIGS. 3, 9, and 10. The lift 56 includes a pair of lifting or booster devices 168 and 170 positioned between the movable member 80 (identified as main chute 30 in FIG. 1) and the base member or main support frame 78. Preferably, each of the devices 168 and 170 has a cylinder 172 connected to the base member and a piston 174 having a generally vertically-extending axis. The upper end 176 of the piston has a generally spherical or similar shape. Support members 178 and 180 are attached to the plates 102 and 104, respectively. The members 178 and 180 have shaped recesses 182 and 184, respectively, formed therein for receiving the ends 176. The boosters, when actuated, assist in the movement of the member 80 from its lowered to its elevated position.

Figure 9:
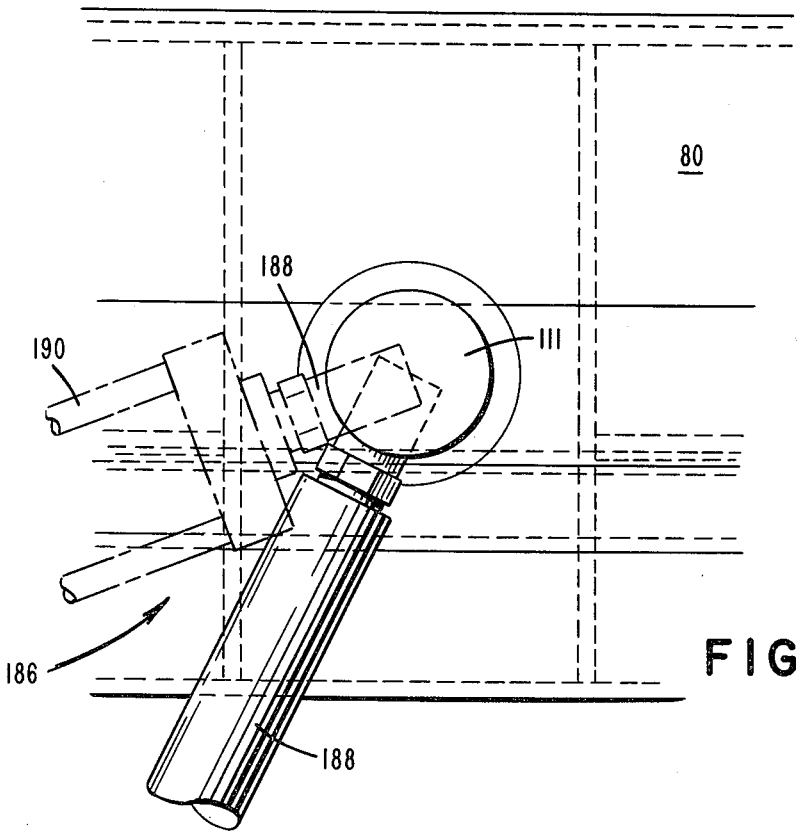
FIG. 9 is a schematic view illustrating the relationship between two components of the apparatus of FIG. 1.

The main lift 56 also includes a pair of main lift devices, one of which generally designated 186; is illustrated in FIGS. 3 and 9. The device 186 is positioned between the main frame 78 and movable member 80. Preferably, the device includes a cylinder 188 pivotally connected to a midportion of main frame 78 and a piston 190 pivotally connected to shaft or rod 111. The rod 111 is located in a forward portion of the member 80. The stroke of the piston 188 is sufficiently long to move the movable member 80 between its first and second positions. Preferably, a mechanism is provided for sensing when the main and inclined chutes are aligned with each other and for stopping movement of the main chute in such aligned position. For this purpose, a contact switch 192 having elements associated with ends 32 and 34 of the chute is illustrated in FIG. 3. It will be appreciated that numerous other mechanisms can be used, such as a mechanism for sensing the amount of movement of rod 190 or a mechanism for sensing the angle formed between the movable and base members.

While the main lift 56 has been described as having four lifting devices, it will be appreciated that as few as one lifting device could be used. The particular described arrangement has been found advantageous because the pistons 190, when extended, enhance lateral stability of the elevated member 80. Also, use of the booster devices 168 and 170 makes it possible to reduce the size of the main cylinders. Further, single acting cylinders are presently being used.

Figure 8:
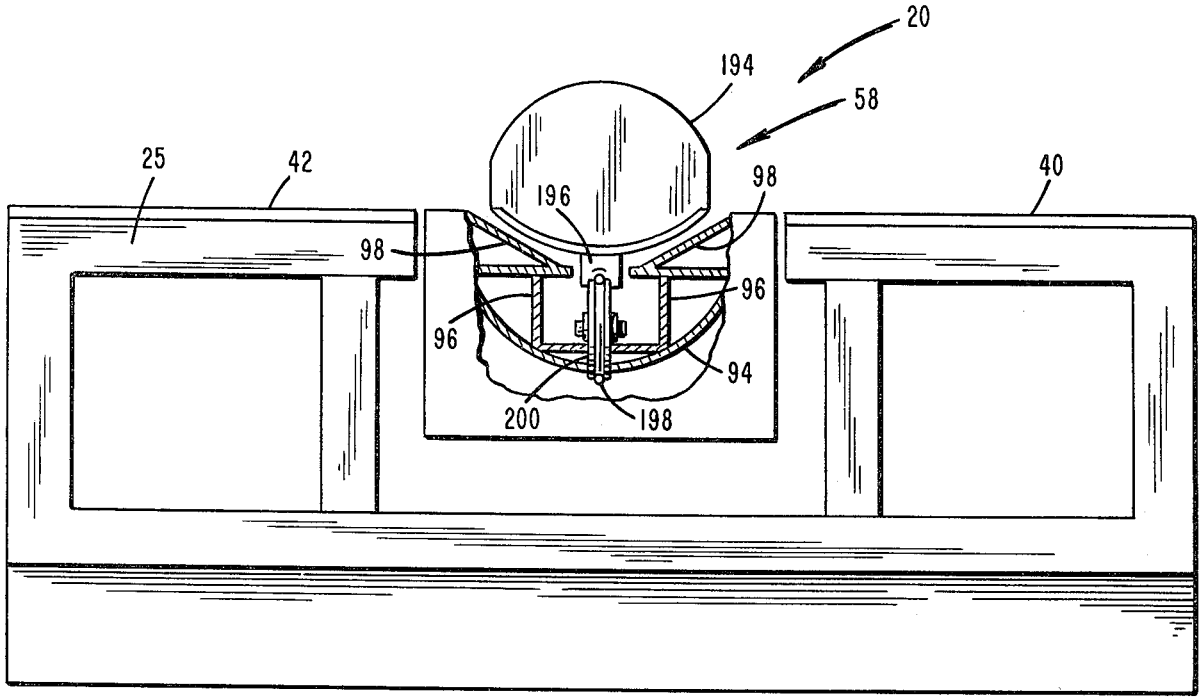
FIG. 8 is a schematic end view, partially in section, of the apparatus illustrated in FIG. 1.

Considering now FIG. 8, a pusher, buggy or bulkhead, generally designated 58, is illustrated. The buggy 58 has an upper portion 194 positioned above at least a part of the trough 101 for engaging a trailing end of a pipe being transported to or from the derrick. A lower portion 196 of the buggy 192 extends downwardly throughout the gap 100 and engages an endless member 198 that passes around pulleys, one of which, designated 200, is illustrated. The pulleys are positioned in trough 101 adjacent end portions thereof. Either one of the pulleys or the endless member 200 is driven by a mechanism (not illustrated) receiving hydraulic fluid through the control valve 50.

As can be seen from FIG. 8, the contour of trough 101 is sufficiently shallow that it cooperates with catwalks 40 and 42 to form a composite catwalk having a width substantially equal to the width of the apparatus 20.

Referring now to FIGS. 11 and 12, a brake, generally designated 68, is illustrated. The brake 68 is connected to the inclined chute 36 and is operative to slow the descent of pipes through the chute during a lay down operation. The brake 68 is designed to be permanently mounted on the chute 36 and has a lever 202 with a pipe engaging surface 204. The lever is pivotally mounted on a pivot pin or shaft 206 carried by a reinforcing plate 208 connected to the chute 36. One end 210 of lever 202 is received between spaced-apart guides extending above the chute 36. A rod 214 of a cylinder 216 is connected to the other end 218 of the lever. The cylinder receives hydraulic fluid either through valve 50 or from the derrick 26 and is operative to move the lever 202 between the pipe engaging position illustrated in solid in FIG. 12 and the disengaged position illustrated in phantom. A diverting plate 220 is positioned upstream of pivot pin 206 to protect the pin from damage by pipes passing through the chute 36.

It should be appreciated that the length of the movable member can be greater than the length of the base frame. With such a construction, the brake can be mounted on a portion of the movable member extending beyond the end of the main support frame. Such a construction would eliminate the need for running a hydraulic line from the apparatus to the derrick and from the derrick to the brake on the inclined chute.

Since the brake lever 202 can be hydraulically moved between the engaged and disengaged positions, there is a significant saving of manpower when shifting between pipe lay down and pipe pick up modes of operation. When needed, the brake lever is moved quickly from its disengaged into its engaged position.

In a modification of the present invention (not illustrated), one or more spring-biased blocking members are located in the main support close to the movable member. Portions of the blocking members extend into the space beneath the movable member, so that the blocking members automatically move into blocking positions when the movable member is raised and are moved into non-blocking positions by movement of the movable member into its first position.

Merely for the purpose of identifying an operative embodiment of the present invention, some examples of suitable commercially available components usable with the present invention will be set forth. It will be understood that numerous other components could be used in place of the identified components.

Suitable components include a Double AA QFH-06 valve for the control valve 50; combined Hydreco 28 PL and 22 PL pumps for the pump 54; an Eaton CharLynn 10,000 motor for driving buggy 58 and an Eaton CharLynn 6,000 motor for rotating shaft 134; and Ortman Miller 3TH—series cylinders of suitable size for cylinders 118, 160, 172, 188, and 216.

In one embodiment of the present invention, each of the catwalks 40 and 42 is approximately 59 feet long by $2\frac{3}{4}$ feet wide, and the member 94 has a radius of curvature of approximately 20 inches. Further, the inclined chute 36 is approximately 57 feet long. With this embodiment, the tops of the catwalks are approximately $3\frac{1}{2}$ feet higher than a surface supporting the apparatus. Also, the distance between pivot 84 and the connection point of cylinder 186 to the main frame is between approximately 25 and 26 feet, and the distance between the shafts 84 and 111 is between approximately 33 and 34 feet. The member 80 is movable through an arc as great as 45°, with an arc of between 19° and 22° being used in one embodiment.

In operation, the apparatus of the present invention is used for a pipe pick up operation as follows. First, the apparatus is set-up for the operation. Set-up includes moving the brake lever 202 to an inoperative position, adjusting the height of the transport mechanisms (124 and 164, for instance) so that the free end of transfer section 128 can be positioned higher than the end connected to the conveying section 126 (although not absolutely required, this step facilitates transfer of pipe from the pipe rack to the conveying section.), moving the movable member to its first, horizontal position, and moving the buggy to the end of the trough spaced furtherest from the derrick. If the apparatus has not been previously used to pick up pipe, set-up includes determining the amount of elevation of the main chute required to move it into substantial alignment with the inclined chute.

After set-up has been completed, a pipe is rolled down the transfer section 128 onto the conveying section 126 which advances the pipe into the main chute. Alternatively, the teeth 140 can be positioned below surface 120 and the pipe rolled directly from the transfer section into the main chute. The main chute is elevated to align the main and elevated chutes. Next, the buggy is moved towards the derrick to push the pipe up the main and inclined chutes into a position in which an end of the pipe is engageable by lifting equipment of the derrick. After the pipe has been removed, the main chute is lowered to receive the next pipe.

Use of the apparatus to perform a pipe lay down operation is quite similar to the aforementioned use of the apparatus. First, the apparatus is set-up by moving the braking lever 202 into an engagement position, adjusting the height of transport mechanism 126 so that the free end of transfer section is lower than the connected end, moving the main chute into an elevated position aligned with the inclined chute, and moving the buggy to a position close to the inclined end of the chute. Next, lifting equipment of the derrick transfers pipe into the inclined chute. After release of the lifting equipment, the lever 202 slows the descent of the pipe into the main chute. After the leading end of the pipe comes to rest against the buggy, the buggy is lowered to transfer the pipe into the main chute. The main chute is then lowered, preferably mostly, or entirely, by gravity. After the chute reaches its horizontal position, the dump mechanism is actuated to rotate section 90 and dump the pipe onto the conveying section 126. Teeth 140 engage the pipe and move it to the transfer section 128 which deposits the pipe on a pipe rack. Previously, specific embodiments of the present invention have been described. It should be appreciated, however, that these embodiments have been described for the purposes of illustration only, without any intention of limiting the scope of the present invention. Rather, it is the intention that the present invention be limited only by the appended claims.

What is claimed is:

1. Pipe handling apparatus for picking up and laying down tubular goods used in a drilling operation, said apparatus comprising:

a longitudinally-extending main support frame;

a longitudinally-extending movable member including means defining a trough for receiving and retaining therein tubular goods and having an end portion pivotally connected to said support frame, and a longitudinally-extending support frame for supporting said trough defining means;

lift means for moving said movable member between a lowered, substantially horizontal, first position and an elevated, second position, said main support frame having a portion thereof defining a horizontal support surface forming a catwalk extending parallel to and spaced from a side of the movable member when the latter is in the first position;

stack means for transferring tubular goods to said movable member and for receiving tubular goods from said movable member when said movable member is in said first position;

dump means operatively associated with said movable member for transferring tubular goods from said movable member to said stack means; and buggy means positioned in said trough for movement with respect thereto, said buggy means being movable to move tubular goods longitudinally along said trough, said trough defining means defining a trough having a plurality of sections, at least one of the sections being supported by said longitudinally-extending support frame for rotation about a longitudinal axis of the section, said dump means comprising means for rotating said at least one rotatable section, and said lift means comprising:

a first lift device positioned between said main support frame and said movable member and having a substantially vertical axis, said first lift device being operable to assist initial movement of said movable member from said first position towards said second position and being spaced from said movable member when said movable member is in said second position; and a second lift device positioned between said main support frame and said movable member and having an axis skew to the vertical, said second lift device being operable to control movement of said movable member between said first and said second positions and supporting said movable member in said second position.

2. Pipe handling apparatus according to claim 1, wherein said second lift device comprises a cylinder pivotally connected to said main support frame and a piston pivotally connected to said movable member.

3. Pipe handling apparatus according to claim 1, wherein said main support frame defines horizontal support surfaces on both sides of said movable member, the trough cooperating with the horizontal support surfaces to define a substantially continuous support surface.

4. Pipe handling apparatus according to claim 1, wherein said stack means is connected to said main support frame and comprises:

a conveying section extending generally perpendicular to the longitudinal axis of the movable member and having an end closest to said movable member positioned beneath the level of said horizontal support surface, said conveying section including a movable member that is protrudable above the support surface to engage and move a pipe;

means for adjusting the vertical height of an end of said conveying section spaced furtherest from said movable member; and transfer means extending away from said conveying section for transferring pipes to and from said conveying section.

5. A pipe handling apparatus for picking up and laying down tubular goods used in a pipe drilling operation, the apparatus picking up tubular goods at a first level and transferring the picked up goods to a second, higher level, and receiving tubular goods from the second level and laying down the received goods at the first level, said apparatus comprising:

a main support frame;

a movable member having a surface for receiving and retaining tubular goods and having a first end portion pivotally connected to said support frame;

lift means for moving a second end portion of said movable member from a first position substantially level with an upper surface of said support frame to a second, raised position in which the second end portion is located close to said second level, said lift means having a first lift device positioned between said main support frame and said movable member, said first lift device being operable to assist initial movement of said movable member from said first position towards said raised position and being spaced from said movable member when said movable member is in said raised position; and a second lift device positioned between said main support frame and said movable member, said second lift device being operable to control movement of said movable member between said first and said raised positions and supporting said movable member in said raised position;

stack means connected to said support frame for moving tubular goods between said first level and said movable member in said first position;

dump means operatively associated with said movable member for transferring tubular goods from said movable member to said stack means; and buggy means operatively associated with the movable member for controlling longitudinal movement of tubular products with respect to said movable member.

6. Pipe handling apparatus according to claim 5, wherein said first lift device has a substantially vertical axis; and said second lift device has an axis skew to the vertical.

7. A pipe handling apparatus according to claim 5, further comprising control means for controlling from a single location said lift means, said stack means, said dump means, and said buggy means.

8. An apparatus according to claim 7, further comprising brake means for braking the rate of movement of tubular products from said second level towards said first level.

9. An apparatus according to claim 8, wherein said brake means is movable by said control means into a braking position when said apparatus is used for laying down tubular products and is movable by said control means into a disengaged position when said apparatus is used for picking up tubular product.

10. An apparatus according to claim 9, wherein said second level is a lower end portion of an inclined chute connected to an elevated platform, said brake means being connected to said inclined chute.

11. In an apparatus for handling tubular goods used in a drilling operation, the apparatus having an inclined chute extending downwardly from an elevated platform, means including a trough for receiving pipe from the inclined chute and for transferring received pipe to a storage location, and means including the trough for transferring pipe from a storage location to and up said inclined chute, the improvement comprising brake means having a lever with one end pivotally connected to a portion of one of said inclined chute and said pipe receiving means on one side of said trough, the lever having a pipe engaging surface positionable to engage and brake tubular goods and a second end received between spaced apart guides extending upwardly from said one of said inclined chute and said pipe receiving means on a side of said trough opposite said one side, and means for moving a portion of said one end of said lever, while still connected to said one of said inclined chute and said trough, between a position in which said pipe engaging surface engages tubular goods moving through said inclined chute and a position in which said pipe engaging surface is free from engagement with tubular goods moving through said inclined chute.

12. In an apparatus for handling tubular goods used in a drilling operation, the apparatus transferring the tubular goods between a storage location and an elevated platform and comprising a support frame located at the storage location, a trough having a first end pivotally connected to the support frame, and lift means for moving the trough between a lowered position in which the trough is positioned to receive goods from the storage location and to transfer goods to the storage location and a raised position in which a second end of the trough is raised so as to permit transfer of goods between the trough and elevated platform, the improvement wherein said lift means comprises:

a first lift device positioned between said support frame and said trough for assisting initial movement of said trough from its lowered position towards its raised position, said first lift device being vertically spaced from said trough when said trough is in the raised position thereof; and a second lift device interconnected between said support frame and said trough and having an axis skew to the vertical, said second lift device being operable to control movement of said trough between said lowered and said raised positions.

* * * * *